US007160084B2

(12) United States Patent
Ahmad

(10) Patent No.: US 7,160,084 B2
(45) Date of Patent: Jan. 9, 2007

(54) BLADE OF A TURBINE

(75) Inventor: Fathi Ahmad, Kaarst (DE)

(73) Assignee: Siemens Aktiengesellschaft, Munich (DE)

( * ) Notice: Subject to any disclaimer, the term of this patent is extended or adjusted under 35 U.S.C. 154(b) by 185 days.

(21) Appl. No.: 10/931,089

(22) Filed: Aug. 31, 2004

(65) Prior Publication Data

US 2005/0106028 A1 May 19, 2005

(30) Foreign Application Priority Data

Sep. 5, 2003 (EP) ..... 03020211

(51) Int. Cl.
*F04D 29/32* (2006.01)

(52) U.S. Cl. ..... 416/231 B; 416/235

(58) Field of Classification Search ..... 416/231 B, 416/231 R, 235, 236 R
See application file for complete search history.

(56) References Cited

U.S. PATENT DOCUMENTS 2,193,686 A * 3/1940 Craddock ..... 416/228
4,846,629 A * 7/1989 Takigawa ..... 416/223 R
6,174,135 B1 * 1/2001 Lee ..... 416/97 R
6,490,791 B1 12/2002 Surace et al.
6,929,451 B1 * 8/2005 Gregg et al. ..... 416/96 R
2001/0016163 A1 * 8/2001 Tomita et al. ..... 416/193 A
2003/0138322 A1 7/2003 Boury et al.

FOREIGN PATENT DOCUMENTS

| | | |
|---|---|---|
| JP | 55096303 | 7/1980 |
| JP | 63248902 | 10/1988 |
| JP | 10299408 | 11/1998 |
| JP | 2000018001 | 1/2000 |

* cited by examiner

*Primary Examiner*—Edward K. Look
*Assistant Examiner*—Devin Hanan

(57) ABSTRACT

The invention relates to a turbine blade (31) having a root region (33), a tip region (37) and a blade airfoil (35), a rounded portion (73) being formed between the root region (33) and the blade airfoil (35), and relief slots (51) passing through the blade trailing edge (41) in the region of this rounded portion (73), thermal expansions being compensated for and thus thermal stresses being minimized by these relief slots (51).

12 Claims, 2 Drawing Sheets

BLADE OF A TURBINE

CROSS REFERENCE TO RELATED APPLICATION

This application claims priority of the European application No. 03020211.3 EP filed Sep. 5, 2003, which is incorporated by reference herein in its entirety.

FIELD OF THE INVENTION

The invention relates to the blade of a turbine, which blade is directed along a blade axis, is formed from a basic body and comprises a root region, a tip region and a blade airfoil having an airfoil height extending from the root region to the tip region. The invention also relates to a method of preventing the propagation of cracks in the blade airfoil of the blade of a turbine.

BACKGROUND OF THE INVENTION

In turbines, a flow medium is transported in a flow duct in order to obtain energy therefrom. To this end, turbine blades are arranged in the flow duct. For example, in the flow duct of an axial gas turbine, guide-blade rings formed from guide blades and moving-blade rings formed from moving blades are arranged alternately following one another in the direction of flow. In a suitable manner, the guide blades deflect the flow medium onto the moving blades, which are connected to a rotor and are set in rotation, so that kinetic energy of the flow medium is converted into rotational energy.

Such blades in fluid-flow machines are often subjected to considerable mechanical loads. Especially at a simultaneous high temperature and high rotary speeds, as in a gas turbine, the blade material is subjected to high stress. As a result, cracks may form in the blade material, and these cracks propagate in the course of time when stress is continuous. Finally, failure of the blade may occur, the blade breaking into pieces or fragments being released. For blades following in the direction of flow, this may lead to considerable damage. The formation and propagation of cracks thus need to be monitored. Depending on the speed of the processes, a significant reduction in the availability of the turbine may occur as a result, since regular service intervals lead to turbine downtimes.

Described in U.S. Pat. No. 6,490,791 is a method in which cracks in the trailing edge of a turbine blade are removed in a service process by cutting back the trailing edge. The additional aerodynamic losses caused by the shortened trailing edge are kept low by subsequent rounding of the blade profile. Although this method can avoid a complete exchange of used blades for new blades, it does not reduce the frequency of the service intervals.

Shown in JP 2000018001 is a gas-turbine moving blade in which relief slots are incorporated in the direction of the blade axis toward the margin of the tip region. These relief slots serve to reduce thermal stresses in this region. The reduction in thermal stresses is intended to reduce crack formation. The relief slots are restricted to the tip region.

JP 10299408 shows a gas-turbine blade in which elliptical holes which are intended to reduce crack propagation are incorporated in regions of high thermal stresses. The holes are arranged in the transition region between blade airfoil and platform, the major axis of the ellipse being directed perpendicularly to the blade axis in the region of the blade airfoil. There is a corresponding orientation of the holes at the trailing edge.

SUMMARY OF THE INVENTION

The object of the invention is to specify a turbine blade which is subjected to especially low thermal stresses.

According to the invention, this object is achieved by a turbine blade which is directed along a blade axis, is formed from a basic body and comprises a root region, a tip region and a blade airfoil having an airfoil height extending from the root region to the tip region and an airfoil width extending from a blade leading edge up to a blade trailing edge, a rounded portion being formed in a transition region between the blade trailing edge and the root region, a relief slot being formed transversely through the blade trailing edge.

The invention is based on the knowledge that the blade trailing edge of a turbine blade is itself subjected to especially high mechanical stresses in a region above the rounded transition region between the blade trailing edge and the root region and in this rounded transition region itself. Furthermore, the invention is based on the knowledge that, given appropriate dimensioning, the blade trailing edge is not unduly destabilized mechanically by slots which run transversely to it. By the introduction of a relief slot transversely to and through the blade trailing edge, considerable relief from thermal stresses is now achieved owing to the fact that thermal expansion can be compensated for by the slot.

The relief slot preferably lies in the vicinity of the rounded portion. The blade trailing edge is subjected to especially high thermal stresses especially in a region in the vicinity of the rounded portion. The stresses in this especially affected region can be effectively reduced by the relief slot. Furthermore, in this case, the relief slot is preferably at a distance from the rounded portion of less than 20% of the airfoil height. A distance of the relief slot from the rounded portion of less than 10% of the airfoil height is especially preferred.

The slot preferably has a length of at least 2% of the airfoil width. With a slot of this extent, an especially high relief effect is achieved by means of the slot.

The slot preferably has at most a length of 5% of the airfoil width. A slot length having an extent greater than 5% of the slot width only leads to a comparatively small further relief of thermal stresses, whereas on the other hand the mechanical stability of the blade trailing edge would suffer by an excessive slot length.

Preferably at least two, more preferably at least three, relief slots are provided. With more than two or three relief slots following one another along the blade axis, a larger region of the blade trailing edge can be relieved of thermal stresses. In addition, higher thermal stresses overall can be countered. All the relief slots are preferably at a distance from the rounded portion within a range of less than 25% of the airfoil height.

Three relief slots are preferably provided, a first slot nearest to the rounded portion having a first length, a second slot following the first slot along the blade axis having a second length, and a third slot following the second slot along the blade axis having a third length, the third length being greater than the second length, and the second length being greater than the first length.

The turbine blade is preferably a gas-turbine blade. Gas turbines are exposed to especially high temperatures. Accordingly, the build-up of especially high thermal stresses occurs precisely in this case.

The relief slot preferably has an approximately circular widened portion at its end opposite the blade trailing edge. Due to such a circular widened portion, the radii of curvature of the surfaces defining the slot at the end are reduced and thus the stresses occurring in particular at such curvatures are reduced. In particular, the circular widened portion is a circular hole, from which the slot extends through the blade trailing edge. The slot is preferably cut by means of a laser beam or it is milled.

The measures described above for the relief of thermal stresses in the blade trailing edge are also equally suitable for reducing stresses in the rounded portion between the blade trailing edge and the root region.

Very high stresses may occur especially in this rounded portion or also in a notch. This zone is thus also a preferred zone for crack formation.

BRIEF DESCRIPTION OF THE DRAWINGS

The invention is explained in more detail by way of example with reference to the drawings.

In the drawings, partly schematically and not to scale.

DETAILED DESCRIPTION OF INVENTION

Figure 1:
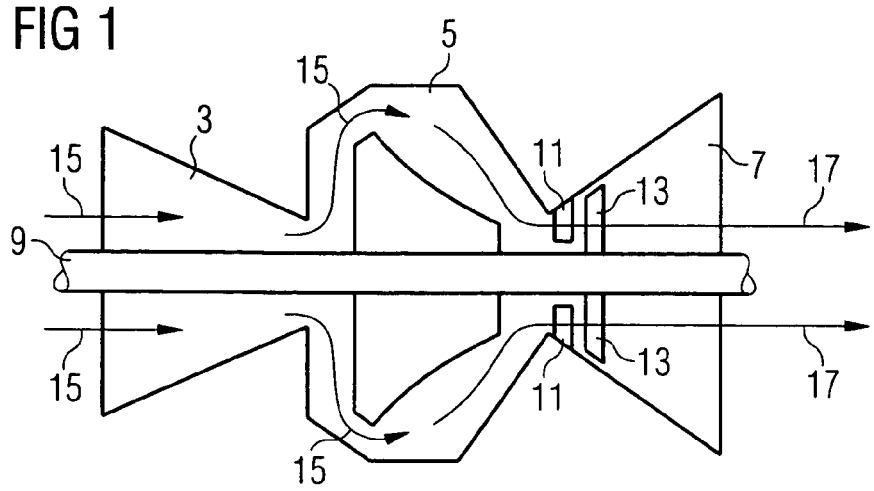
FIG. 1 shows a gas turbine.

The same reference numerals have the same meaning in the various figures.

FIG. 1 shows a gas turbine 1. The gas turbine 1 is directed along a turbine axis 10 and has, following one another along the turbine axis 10, a compressor 3, a combustion chamber 5 and a turbine part 7. The compressor 3 and the turbine part 7 are arranged on a common turbine shaft 9. Formed in the turbine part 7 is a hot-gas duct 12, into which guide blades 11 and moving blades 13, which are arranged on the turbine shaft 9, project.

During operation of the gas turbine 1, ambient air is drawn in by the compressor 3 and compressed to form compressor air 15. The compressor air 15 is burned with fuel in the combustion chamber 5 to form hot gas 17, which flows through the hot-gas duct 12. In the process, the turbine shaft 9 is set in motion via the effect on the moving blades 13. The rotational energy of the turbine shaft 9 can be used, for example, for generating electrical energy.

Figure 2:
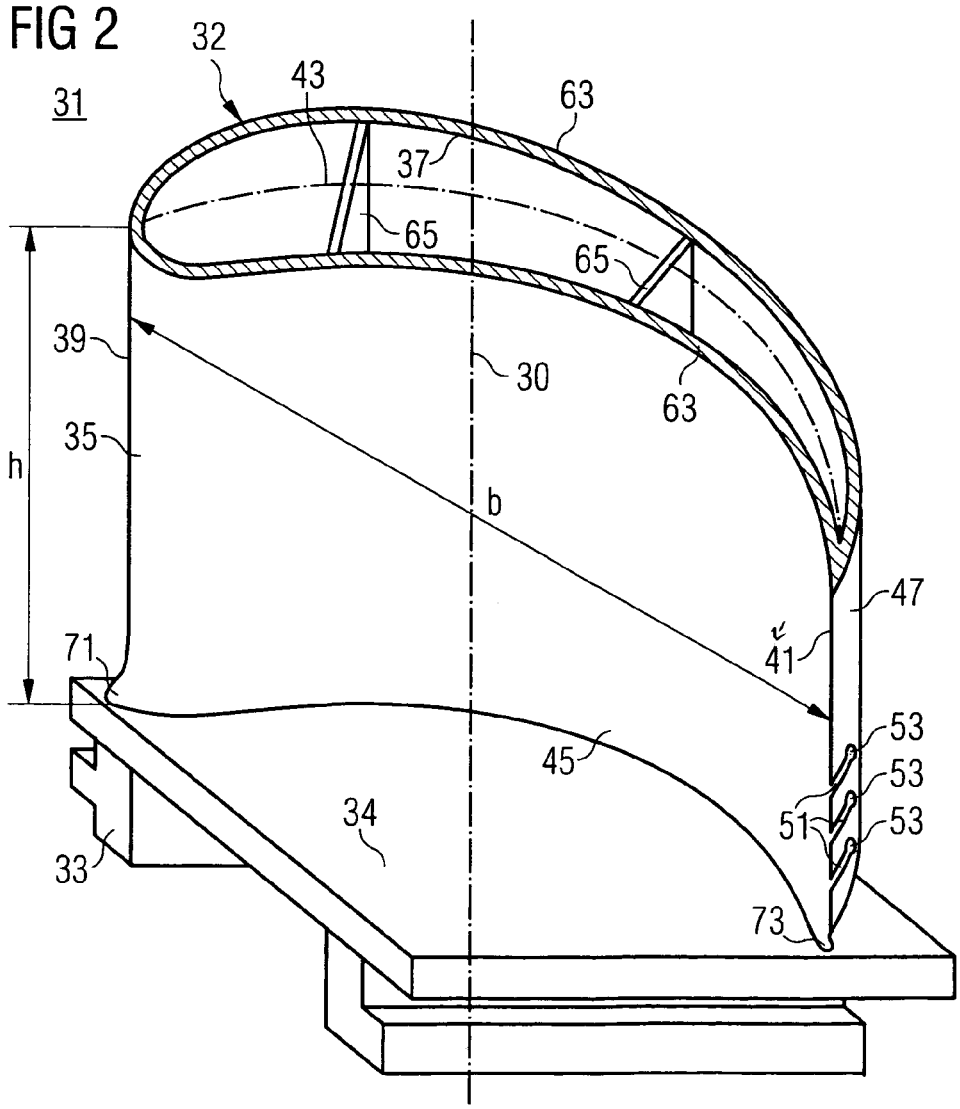
FIG. 2 shows a gas-turbine guide blade.

FIG. 2 shows a gas-turbine guide blade 31. The gas-turbine guide blade 31 has a root region 33 with a platform 34. A blade airfoil 35 adjoins the platform 34. The blade airfoil 35 ends in a tip region 37, which in particular also has a platform, which, however, is not shown here. The platform 34 and also the platform (not shown) of the tip region 37 serve to define the hot-gas duct 12. The blade airfoil 35 has an airfoil height h. Furthermore, the blade airfoil 35 has a blade width b. The blade airfoil 35 extends from a blade leading edge 39 to a blade trailing edge 41. The pressure side 45, on the one hand, and the opposite suction side 47, on the other hand, of the blade airfoil 35 lie between blade leading edge 39 and blade trailing edge 41. The gas-turbine guide blade 31 has a basic body 32 which is of hollow design, a blade outer wall 63 enclosing the cavity. Stabilizing side ribs 65 are arranged in the cavity between the suction side 47 and the pressure side 45.

In the transition region between blade airfoil 35 and platform 34, a rounded portion 71 is formed in the region of the blade leading edge 39 and a rounded portion 73 is formed in the region of the blade trailing edge 41. These rounded portions 71, 73, also referred to as thickened portions or notches, are subjected to especially high mechanical stresses during operation. For relief from thermal stresses which occur due to the high temperatures to which the gas-turbine guide blade 31 is exposed, relief slots 51 are provided in the blade trailing edge. These relief slots 51 are described in more detail with reference to FIG. 3.

Figure 3:
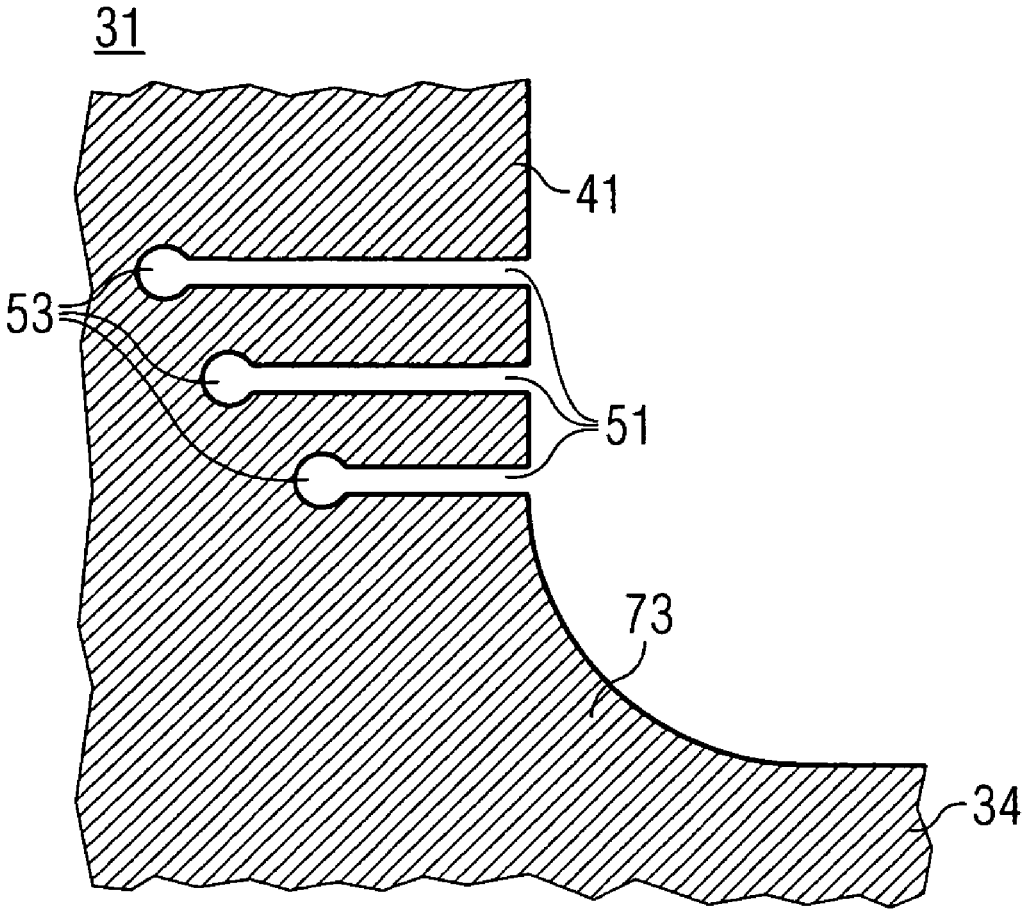
FIG. 3 shows a detail of a longitudinal section through a gas-turbine guide blade in the region of the rounded portion between blade trailing edge and root region.

FIG. 3 shows a detail of a longitudinal section through the gas-turbine guide blade 31 in the region of the rounded portion 73 between blade trailing edge 41 and platform 34. The relief slots 51 extend transversely to and through the blade trailing edge 41. In this case, the blade trailing edge 41 may be formed, for example, solely by the suction side 47, whereas the pressure side 45 ends in a stepped manner, and cooling-air openings which cool the blade trailing edge 41 are provided in this step. This would be an open blade trailing edge 41. However, there may also be a closed blade trailing edge 41, in which the pressure side 45 merges in a rounded manner into the suction side 47 and forms the blade trailing edge 41 in the process. In this case, the relief slots 51 may extend in the suction side 47, the pressure side 45 or in both sides. With their ends opposite the blade trailing edge 41, the relief slots 51 end in circular widened portions 53, in which comparatively few stresses are caused due to a relatively small curvature. The relief slot 51 nearest to the rounded portion has a smaller volume than the second relief slot following in the blade axis direction. The second relief slot is in turn shorter than the third relief slot 51 which follows it in the direction of the blade axis and is furthest away from the rounded portion 73.

Thermal stresses are reduced by the relief slots 51 by virtue of the fact that a thermal expansion can be compensated for in the relief slots 51. As a result, thermal stresses both in the region of the trailing edge 41 and in the rounded portion 73 are minimized.

Cooling air 67 for the cooling is directed into the gas-turbine guide blade 34. This cooling air 67 comes out of the slot 51 from the hollow interior of the gas-turbine guide blade 34. In this case, the slot 51 is shaped in such a way that the cooling air 67 forms a cooling film on the surface of the blade airfoil 35.

The invention claimed is:

1. A turbine blade that is directed along a blade axis, comprising:

a root region;

a tip region;

a blade airfoil having an airfoil height extending from the root region to the tip region;

an a foil width extending from a blade leading edge up to a blade trailing edge, a blended portion formed in a transition region between the blade trailing edge and the root region; and a recess sized and configured to reduce mechanical stress and formed transversely and entirely through the blade trailing edge, and further wherein the recess is located to reduce mechanical stress in the vicinity of the blended portion.

2. The turbine blade as claimed in claim 1, wherein the recess is located in the vicinity of the blended portion.

3. The turbine blade as claimed in claim 2, wherein the recess is at a distance from the blended portion of less than 20% of the airfoil height.

4. The turbine blade as claimed in claim 1, wherein the recess has a length of at least 2% of the airfoil width.

5. The turbine blade as claimed in claim 1, wherein the recess has a length of at most 5% of the airfoil width.

6. The turbine blade as claimed in claim 1, wherein the recess is a slot.

7. The turbine blade as claimed in claim 6, wherein there are a plurality of slots.

8. The turbine blade as claimed in claim 7, wherein a first slot nearest to the rounded portion has a first length, a second slot located adjacent to the first slot along the blade axis has a second length, and a third slot adjacent to the second slot but not the first slot has a third length, the third length being greater than the second length, and the second length being greater than the first length.

9. The turbine blade as claimed in claim 6, wherein the slot has a straight portion and a circular portion.

10. The turbine blade as claimed in claim 9, wherein the slot has an approximately circular portion toward an end opposite the blade trailing edge.

11. The turbine blade as claimed in claim 1, wherein the turbine blade is designed as a gas-turbine blade.

12. The turbine blade as claimed in claim 1, wherein the recess has an approximately circular portion toward an end opposite the blade trailing edge.

* * * * *